US006236165B1

(12) United States Patent
Ishizuka

(10) Patent No.: US 6,236,165 B1
(45) Date of Patent: May 22, 2001

(54) AC PLASMA DISPLAY AND METHOD OF DRIVING THE SAME

(75) Inventor: Mitsuhiro Ishizuka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/489,826

(22) Filed: Jan. 24, 2000

(30) Foreign Application Priority Data

Jan. 22, 1999 (JP) ..... 11-014669

(51) Int. Cl.[7] ..... G09G 3/10

(52) U.S. Cl. ..... 315/169.1; 315/169.4; 345/68; 345/208

(58) Field of Search ..... 315/169.4, 169.1; 345/68, 208, 209, 210, 204

(56) References Cited

U.S. PATENT DOCUMENTS 6,140,775 * 10/2000 Hirakawa ..... 315/169.4

* cited by examiner

*Primary Examiner*—David Vu

(74) *Attorney, Agent, or Firm*—Young & Thompson

(57) ABSTRACT

The present invention provides a method of driving an AC plasma display comprising the steps of: at least any one of applying a first type priming pulse with a positive polarity having a gentle rise to a scanning electrode and applying a second type priming pulse with a negative polarity having a gentle fall to a sustaining electrode; at least any one of applying the sustaining electrode with a first charge adjustment pulse with a positive polarity having a gentle rise as an erasing pulse for reducing wall charges formed on the sustaining electrode by priming, and applying the scanning electrode with a second charge adjustment pulse with a negative polarity having a gentle fall as an erasing pulse for reducing wall charges formed on the scanning electrode by priming; applying a scanning pulse with a negative polarity onto the scanning electrode and a data pulse with a positive polarity onto a data electrode so as to erase the wall charges of a selected cell; at least any one of applying a first erasing pulse with a positive polarity having a gentle rise to the scanning electrode and applying a second erasing pulse with a negative polarity having a gentle fall to the sustaining electrode so as to erase positive charges adhered on the scanning electrode upon erasing the wall charges of the selected cell; and sustaining a luminescence during a sustaining time period at unerased parts.

12 Claims, 26 Drawing Sheets weak discharge weak discharge weak discharge

AC PLASMA DISPLAY AND METHOD OF DRIVING THE SAME

BACKGROUND OF THE INVENTION

The present invention relates to an AC plasma display and a method of driving the same, and more particularly to an AC plasma display having a low background brightness and a good dark adaptive ambient contrast and a wide operable voltage range and a method of driving the same.

The plasma display panel is advantageous in possible reduction in thickness thereof, and also in its large contrast in display without substantial flicker as well as advantageous in possible enlargement of its screen. The plasma display panel is further advantageous in high response speed and realizing a multi-color display by utilizing a fluorescent material due to self-emission type display. In recent years, the plasma display panel has been becoming to be used widely in various fields of displays for computers and color-displays. The plasma display panel may be isolated into two types. The first type is an AC plasma display panel operated by an AC discharge indirectly between electrodes coated with dielectric films. The second type is a DC plasma display panel operated by a DC discharge directly between electrodes exposed to a discharge space. The AC plasma display panel is further isolated into two AC types, wherein the first type is a memory operating AC plasma display panel operable by utilizing a memory function of discharge cells and the second type is a refresh AC plasma display panel operable without utilizing a memory function. The brightness of the plasma display panel is proportional to the number of discharge or the number of pulse voltage application. The refresh AC plasma display panel is suitable for a small display capacity plasma display panel since an enlargement of the display capacity causes a drop of the brightness.

A first conventional method of driving the plasma display panel is disclosed in Japanese laid-open patent publication No. 8-272335. FIG. 24 is a timing chart illustrative of a first conventional method of driving the plasma display panel. The priming pule is rectangular-waveform whereby the discharge is strong. If no image is displayed on the screen, a luminescence can appear to increase the brightness of the background whereby a contrast of the dark ambient is deteriorated. The strong discharge priming requires a sufficiently high level of the voltage necessary for priming in relation to the discharge initiation voltage whereby a large amount of the wall charges is formed so that a self-erasing discharge may be caused due to only the wall charges and the wall charges are erased even the wall charges should remain for subsequent third time period for selective erasing the wall charges. Farther application of the wide erasing pulse causes a problem with a narrow available driving voltage range.

In the above circumstances, it had been required to develop a novel method of driving the AC plasma display panel free from the above problem.

SUMMARY OF THE INVENTION

Accordingly, it is an object of the present invention to provide a novel method of driving the AC plasma display panel free from the above problems.

It is a further object of the present invention to provide a novel AC plasma display panel.

The present invention provides a method of driving an AC plasma display comprising the steps of: at least any one of applying a first type priming pulse with a positive polarity having a gentle rise to a scanning electrode and applying a second type priming pulse with a negative polarity having a gentle fall to a sustaining electrode; at least any one of applying the sustaining electrode with a first charge adjustment pulse with a positive polarity having a gentle rise as an erasing pulse for reducing wall charges formed on the sustaining electrode by priming, and applying the scanning electrode with a second charge adjustment pulse with a negative polarity having a gentle fall as an erasing pulse for reducing wall charges formed on the scanning electrode by priming; applying a scanning pulse with a negative polarity onto the scanning electrode and a data pulse with a positive polarity onto a data electrode so as to erase the wall charges of a selected cell; at least any one of applying a first erasing pulse with a positive polarity having a gentle rise to the scanning electrode and applying a second erasing pulse with a negative polarity having a gentle fall to the sustaining electrode so as to erase positive charges adhered on the scanning electrode upon erasing the wall charges of the selected cell; and sustaining a luminescence during a sustaining time period at unerased parts.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

DISCLOSURE OF THE INVENTION

Figure 1:
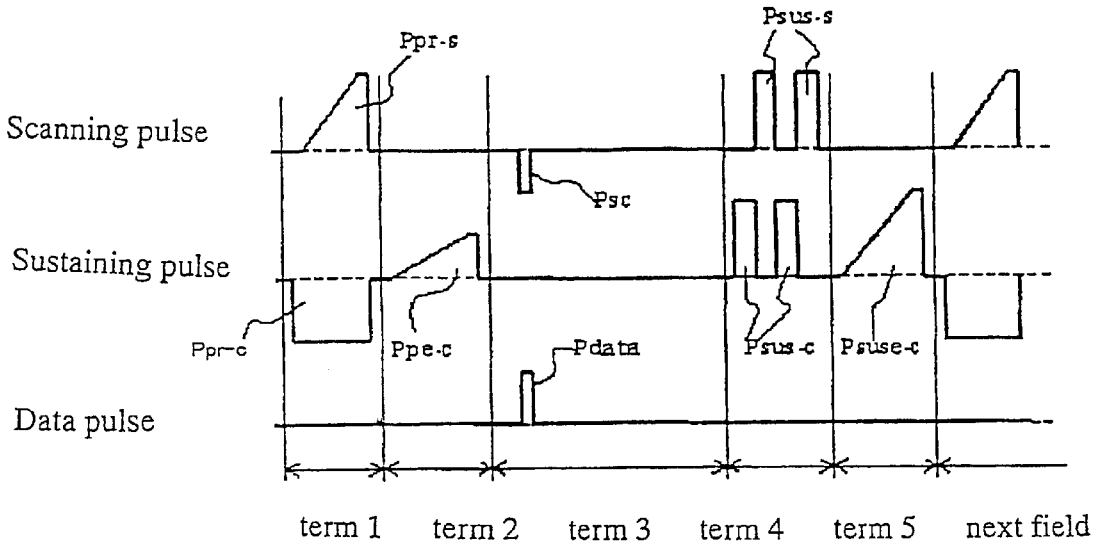
FIG. 1 is a timing chart illustrative of a novel method of driving the AC plasma display in a first embodiment in accordance with the present invention.

The present invention provides a method of driving an AC plasma display comprising the steps of: at least any one of applying a first type priming pulse with a positive polarity having a gentle rise to a scanning electrode and applying a second type priming pulse with a negative polarity having a gentle fall to a sustaining electrode; at least any one of applying the sustaining electrode with a first charge adjustment pulse with a positive polarity having a gentle rise as an erasing pulse for reducing wall charges formed on the sustaining electrode by priming, and applying the scanning electrode with a second charge adjustment pulse with a negative polarity having a gentle fall as an erasing pulse for reducing wall charges formed on the scanning electrode by priming; applying a scanning pulse with a negative polarity onto the scanning electrode and a data pulse with a positive polarity onto a data electrode so as to erase the wall charges of a selected cell; at least any one of applying a first erasing pulse with a positive polarity having a gentle rise to the scanning electrode and applying a second erasing pulse with a negative polarity having a gentle fall to the sustaining electrode so as to erase positive charges adhered on the scanning electrode upon erasing the wall charges of the selected cell; and sustaining a luminescence during a sustaining time period at unerased parts.

It is preferable that one sub-field representing a gray scale comprises a priming time period, a charge adjustment time period, a scanning time period, and a sustaining and erasing time period.

It is further preferable that a sub-scanning pulse is applied to the sustaining electrode in the scanning time period.

It is also preferable that in the sustaining time period, a sustaining pulse with the negative polarity is first applied to the scanning electrode and then the sustaining pulses are alternatively applied to the sustaining electrode and the scanning electrode.

The present invention provides a method of driving an AC plasma display comprising the steps of at least any one of applying a first type priming pulse with a saw-tooth waveform and a positive polarity having a gentle rise to a scanning electrode and applying a second type priming pulse with a saw-tooth waveform and a negative polarity having a gentle fall to a sustaining electrode; at least any one of applying the sustaining electrode with a first charge adjustment pulse with a positive polarity having a gentle rise as an erasing pulse for reducing wall charges formed on the sustaining electrode by priming, and applying the scanning electrode with a second charge adjustment pulse with a negative polarity having a gentle fall as an erasing pulse for reducing wall charges formed on the scanning electrode by priming; applying a scanning pulse with a negative polarity onto the scanning electrode and a data pulse with a positive polarity onto a data electrode so as to erase the wall charges of a selected cell; at least any one of applying a first erasing pulse with a positive polarity having a gentle rise to the scanning electrode and applying a second erasing pulse with a negative polarity having a gentle fall to the sustaining electrode so as to erase positive charges adhered on the scanning electrode upon erasing the wall charges of the selected cell; and sustaining a luminescence during a sustaining time period at unerased parts.

It is preferable that one sub-field representing a gray scale comprises a priming time period, a charge adjustment time period, a scanning time period, and a sustaining and erasing time period.

It is also preferable that the erasing pulse is applied to the sustaining electrode in the sustaining and erasing time period.

It is also preferable that a sub-scanning pulse is applied to the sustaining electrode in the scanning time period.

It is also preferable that the sustaining and erasing time period is between the scanning time period and the sustaining time period so that in the sustaining and erasing time period, a pre-sustaining erasing pulse with a saw-tooth waveform and a positive polarity is applied to the scanning electrode.

It is also preferable that the sustaining and erasing time period is between the scanning time period and the sustaining time period so that in the sustaining and erasing time period, a pre-sustaining erasing pulse with a saw-tooth waveforn and a negative polarity is applied to the scanning electrode.

The present invention provides an AC plasma display comprising: means for at least any one of applying a first type priming pulse with a positive polarity having a gentle rise to a scanning electrode and applying a second type priming pulse with a negative polarity having a gentle fall to a sustaining electrode; means for at least any one of applying the sustaining electrode with a first charge adjustment pulse with a positive polarity having a gentle rise as an erasing pulse for reducing wall charges formed on the sustaining electrode by priming, and applying the scanning electrode with a second charge adjustment pulse with a negative polarity having a gentle fall as an erasing pulse for reducing wall charges formed on the scanning electrode by priming; means for applying a scanning pulse with a negative polarity onto the scanning electrode and a data pulse with a positive polarity onto a data electrode so as to erase the wall charges of a selected cell; means for at least any one of applying a first erasing pulse with a positive polarity having a gentle rise to the scanning electrode and applying a second erasing pulse with a negative polarity having a gentle fall to the sustaining electrode so as to erase positive charges adhered on the scanning electrode upon erasing the wall charges of the selected cell; and means for sustaining a luminescence during a sustaining time period at unerased parts.

The present invention also provides an AC plasma display comprising: means for at least any one of applying a first type priming pulse with a saw-tooth waveform and a positive polarity having a gentle rise to a scanning electrode and applying a second type priming pulse with a saw-tooth waveform and a negative polarity having a gentle fall to a sustaining electrode; means for at least any one of applying the sustaining electrode with a first charge adjustment pulse with a positive polarity having a gentle rise as an erasing pulse for educing wall charges formed on the sustaining electrode by priming, and applying the scanning electrode with a second charge adjustment pulse with a negative polarity having a gentle fall as an erasing pulse for reducing wall charges formed on the scanning electrode by priming; means for applying a scanning pulse with a negative polarity onto the scanning electrode and a data pulse with a positive polarity onto a data electrode so as to erase the wall charges of a selected cell; mean for at least any one of applying a first erasing pulse with a positive polarity having a gentle rise to the scanning electrode and applying a second erasing pulse with a negative polarity having a gentle fall to the sustaining electrode so as to erase positive charges adhered on the scanning electrode upon erasing the wall charges of the selected cell; and means for sustaining a luminescence during a sustaining time period at unerased parts.

Preferred Embodiment

Figure 7:
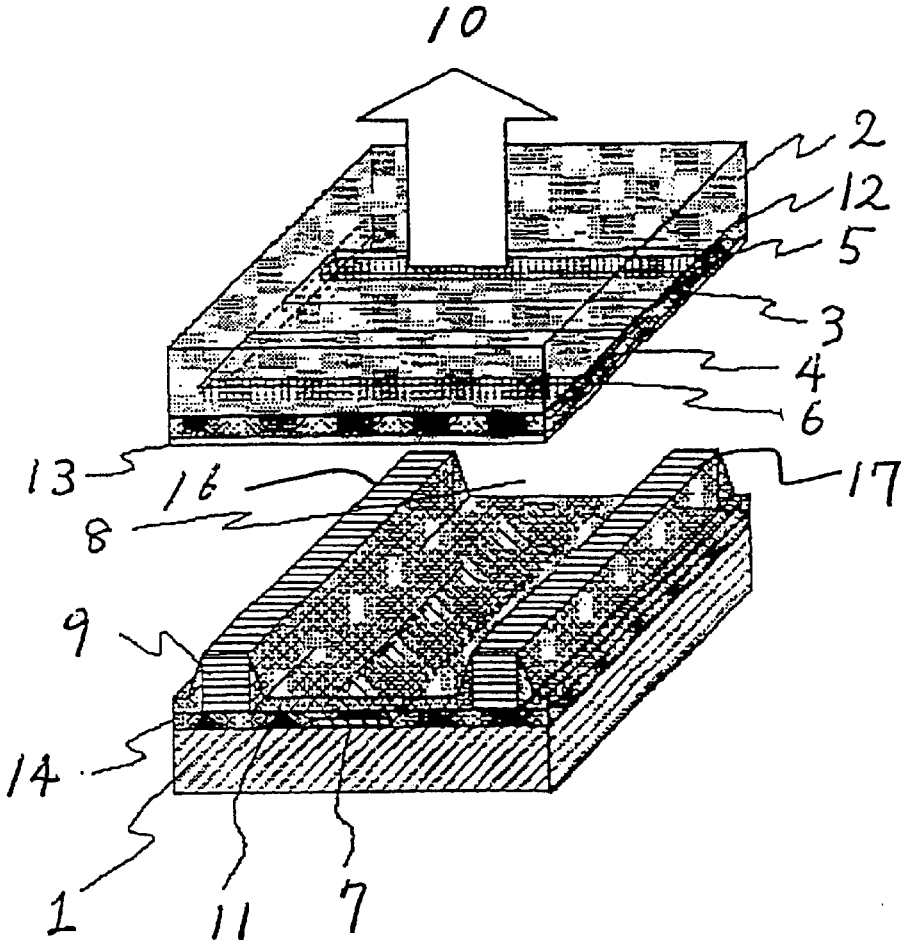
FIG. 7 is a schematic perspective view illustrative of a display cell structure of an AC plasma display panel.

A first embodiment according to the present invention will be described in detail with reference to the drawings. FIG. 7 is a schematic perspective view illustrative of a display cell structure of an AC plasma display panel. A discharge cell is defined between first and second insulating substrates 1 and 2 which are made of a glass. The first insulating substrate 1 is positioned in a back side and the second insulating substrate 2 is positioned in a front side. On an inside surface of the second insulating substrate 2, a stripe shaped scanning electrode 3 and a stripe shaped sustaining electrode 4 extend at a distance in parallel to each other and in a first lateral direction. A first trace electrode 5, which is stripe-shaped, is laminated on a selected part of the scanning electrode 3 in order to reduce a resistance of the scanning electrode 3. The first trace electrode 5 extends in the same direction as the scanning electrode 3. A second trace electrode 6, which is stripe-shaped, is laminated on a selected part of the sustaining electrode 4 in order to reduce a resistance of the sustaining electrode 4. The second trace electrode 6 extends in the same direction as the sustaining electrode 4. On an inside surface of the first insulating substrate 1, a stripe shaped data electrode 7 extends in a second lateral direction which is perpendicular to the first lateral direction along which the scanning electrode 3 and the sustaining electrode 4 extend. A first dielectric layer 14 is provided which covers the entire inside face of the first insulating substrate 1, so that the data electrode 7 is covered with the first dielectric layer 14. A pair of first and second stripe-shaped ridges 16 and 17 is provided on the first dielectric layer 14, so that the first and second stripe-shaped ridges 16 and 17 extend in parallel to each other and also parallel to the data electrode 7. The first and second stripe-shaped ridges 16 and 17 are distanced so that the first and second stripe-shaped ridges 16 and 17 extend in opposite sides of the data electrode 7 but are separated from opposite side edges of the data electrode 7. A fluorescent material 11 is provided on the surface of the first dielectric layer 14 and also on side walls of the first and second stripe-shaped ridges 16 and 17. The above scanning electrode 3, the sustaining electrode 4, and the first and second trace electrodes 5 and 6 are transparent to allow a light to be transmitted through them. A second dielectric layer 12 is also provided which covers an entire inside surface of the second insulating substrate 2 so that the scanning electrode 3, the sustaining electrode 4, and the first and second trace electrodes 5 and 6 are covered with the second dielectric layer 12. A protective layer 13 is further provided on the second dielectric layer 12. A discharge space 8 is defined between the protective layer 13 and the fluorescent material 11 and also between the first and second ridges 16 and 17. The discharge space 8 is filled with a discharge gas, for example, a helium gas, a neon gas, a xenon gas or a mixture gas thereof, so that a discharge in the discharge space 8 filled with the discharge gas causes an ultraviolet ray and this ultraviolet ray is converted by the fluorescent material 11 into a visible light 10.

Figure 8:
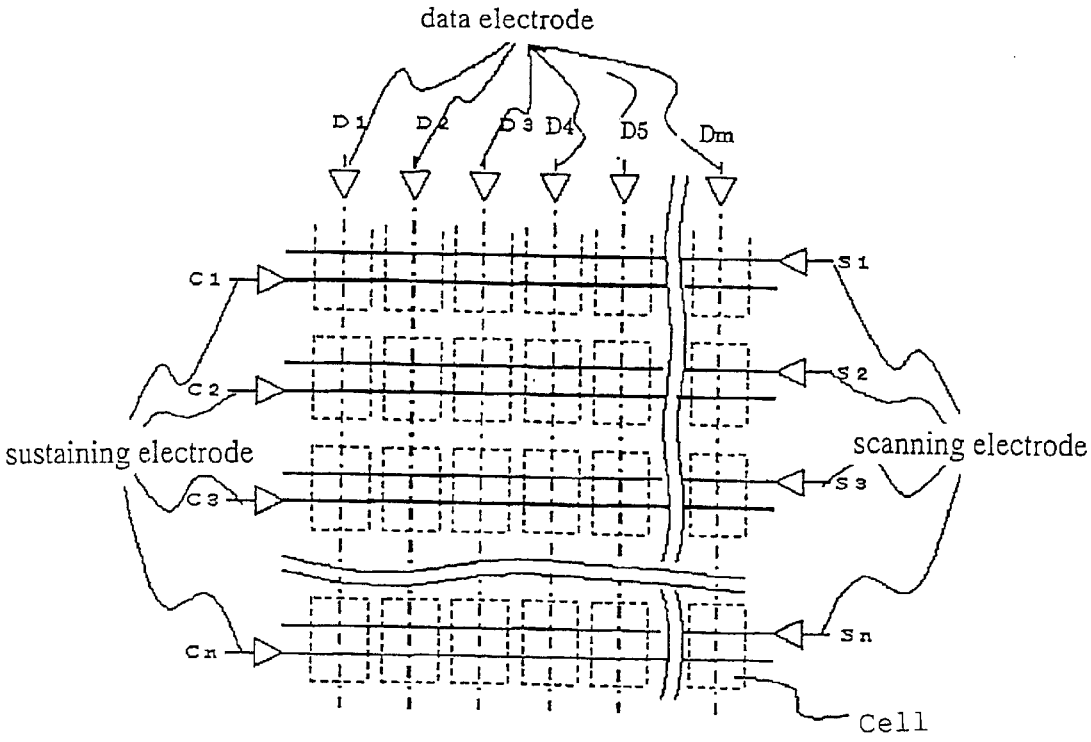
FIG. 8 is a diagram illustrative of an arrangement of sustaining electrodes, sustaining electrodes and scanning electrodes of the AC plasma display panel.

FIG. 8 is a diagram illustrative of an arrangement of sustaining electrodes, sustaining electrodes and scanning electrodes of the AC plasma display panel. A plurality of sets of a sustaining electrode and a scanning electrode are provided so that the sustaining electrodes and the scanning electrodes extend in a first horizontal direction. A plurality of data electrodes are also provided which extend in a second horizontal direction perpendicular to said first horizontal direction. Each cell is represented by a broken line which encompasses two crossing points of the single data electrode and single sustaining electrode and the single scanning electrode.

Figure 9:
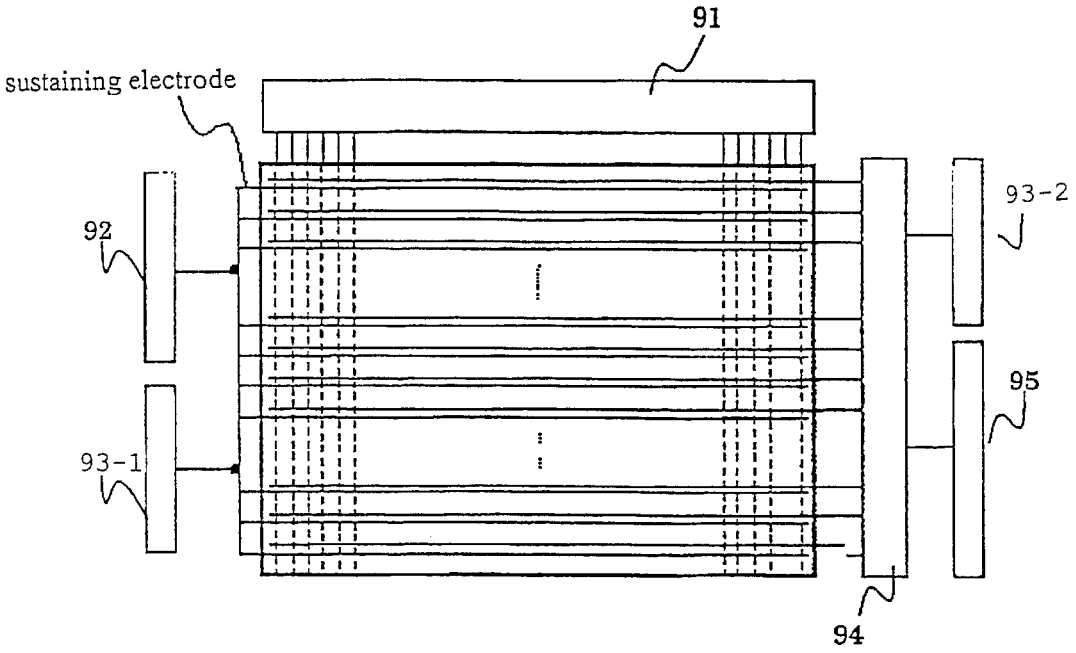
FIG. 9 is a diagram illustrative of a configuration of a driving circuit of an AC plasma display panel.
Figure 10:
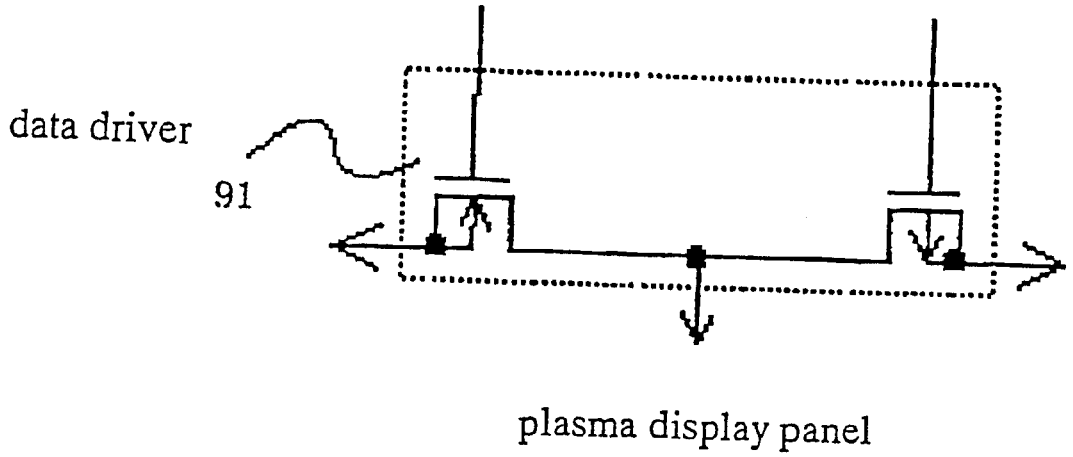
FIG. 10 is a circuit diagram illustrative of one example of a circuit configuration of a data driver shown in FIG. 9.
Figure 11:
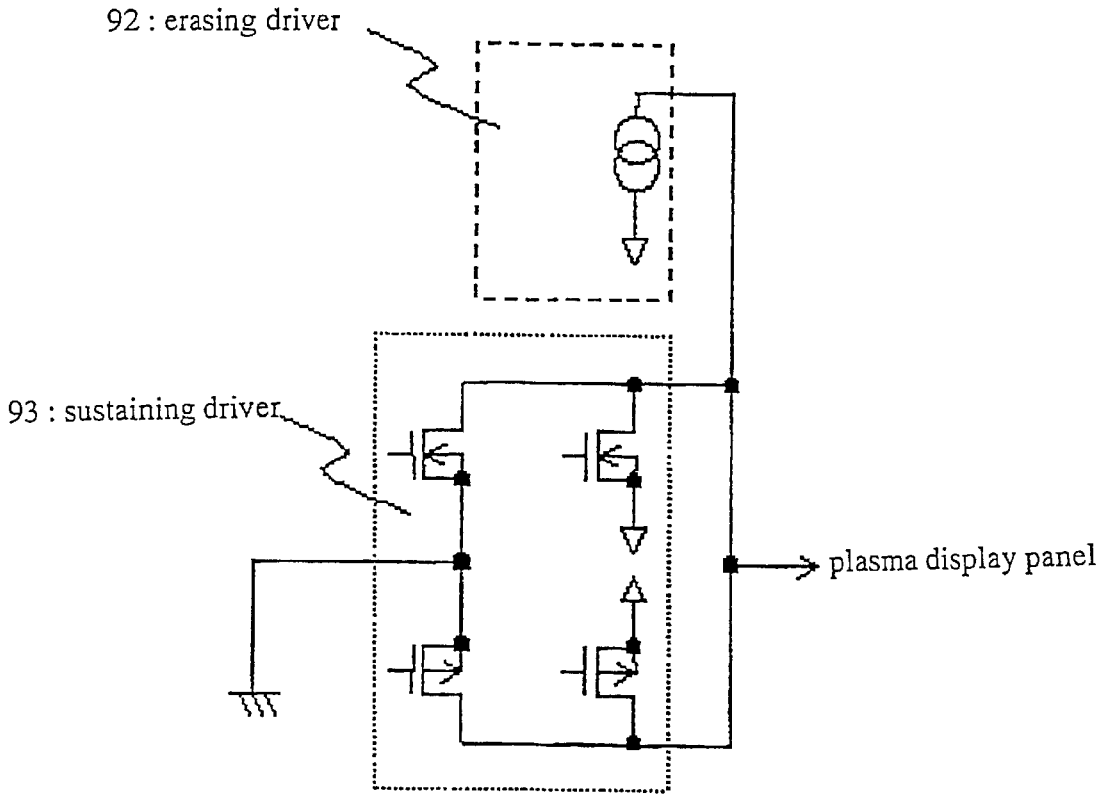
FIG. 11 is a circuit diagram illustrative of one example of a circuit configuration of an erasing driver and a sustaining driver shown in FIG. 9.
Figure 12:
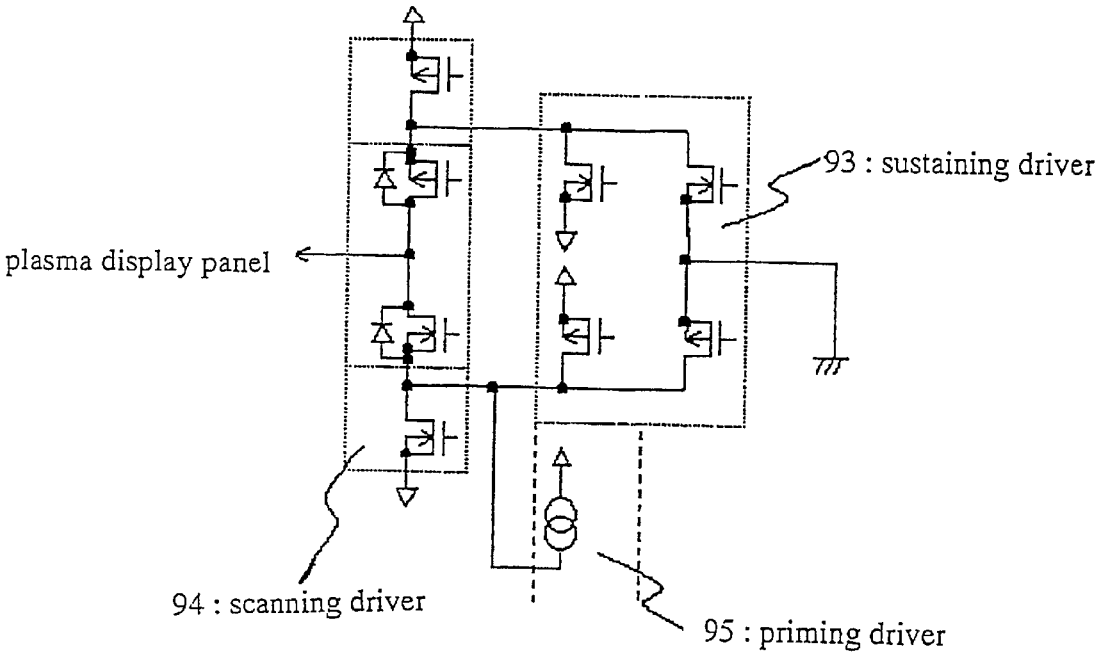
FIG. 12 is a circuit diagram illustrative of one example of a circuit configuration of a scanning driver, a sustaining driver and a priming driver shown in FIG. 9.

FIG. 9 is a diagram illustrative of a configuration of a driving circuit of an AC plasma display panel A data driver 91 is connected to the data electrodes for driving the data electrodes. An erasing driver 92 is connected to the sustaining electrodes for driving the sustaining electrodes to apply erasing pulses to the sustaining electrodes. A first sustaining driver 93-1 is connected to the sustaining electrodes for driving the sustaining electrodes to apply sustaining pulses to the sustaining electrodes. A scanning driver 94 is connected to the scanning electrodes for driving the scanning electrodes. A second sustaining driver 93-2 is connected to the scanning driver 94 for allowing the scanning driver 94 to generate a common sustaining pulse to all of the scanning electors. A priming driver 95 is connected to the scanning driver 94 for allowing the scanning driver 94 to generate a common priming pulse to all of the scanning electors. FIG. 10 is a circuit diagram illustrative of one example of a circuit configuration of a data driver shown in FIG. 9. FIG. 11 is a circuit diagram illustrative of one example of a circuit configuration of an erasing driver and a sustaining driver shown in FIG. 9. FIG. 12 is a circuit diagram illustrative of one example of a circuit configuration of a scanning driver, a sustaining driver and a priming driver shown in FIG. 9.

A novel method of driving the AC plasma display in accordance with the present invention will be described. FIG. 1 is a timing chart illustrative of a novel method of driving the AC plasma display in a first embodiment in accordance with the present invention. In a time period 1 as a priming time period, a priming pulse Pre-s with a saw tooth waveform is applied to the scanning electrodes S1, - - - Sn, whilst a priming pulse Ppr-c with a rectangular waveform is applied to the sustaining electrodes C1, - - - Cn.

Figure 13:
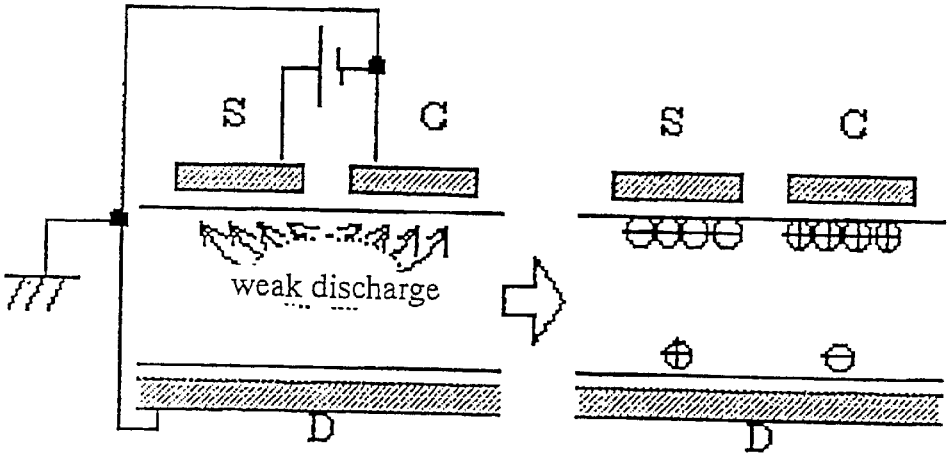
FIG. 13 is a diagram illustrative of movement of charges in the first time period 1 as the priming time period shown in FIG. 1.

FIG. 13 is a diagram illustrative of movement of charges in the first time period 1 as the priming fine period shown in FIG. 1. In the time period 1 as the priming time period, a priming pulse Pre-s with a saw tooth waveform is applied to the scanning electrodes S1, - - - Sn, whilst a priming pulse Ppr-c with a rectangular waveform is applied to the sustaining electrodes C1, - - - Cn, whereby a priming discharge is caused in each discharge space adjacent to gap between the scanning electrode and the sustaining electrode thereby generating active particles which promote discharge of the cell. Further, wall charges with the negative polarity are adhered on the scanning electrode, whilst wall charges with the positive polarity are adhered on the sustaining electrode.

Figure 14:
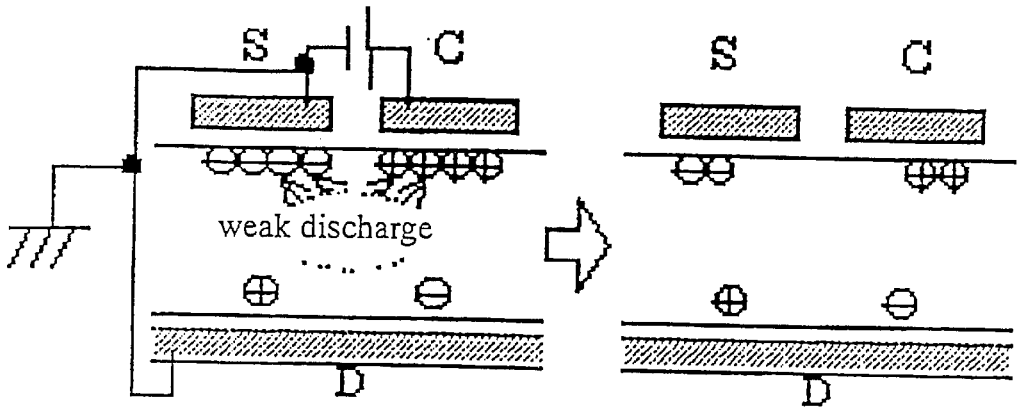
FIG. 14 is a diagram illustrative of movement of charges in the second time period 2 as the charge adjustment time period shown in FIG. 1.

FIG. 14 is a diagram illustrative of movement of charges in the second time period 2 as the charge adjustment time period shown in FIG. 1. In the time period 2 as the charge adjustment time period, a charge adjustment pulse Ppe-c with a saw-tooth waveform is applied for selectively erasing the wall charges adhered on the scanning electrodes and the sustaining electrodes.

Figure 15A:
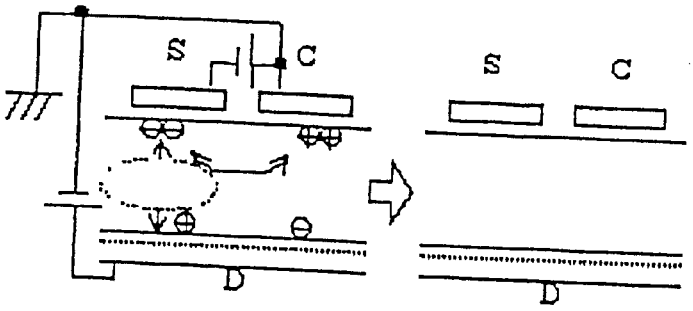
FIG. 15A is a diagram illustrative of movement of charges in the third time period 3 as the scanning time period shown in FIG. 1, where a data pulse is applied to the data electrode.
Figure 15B:
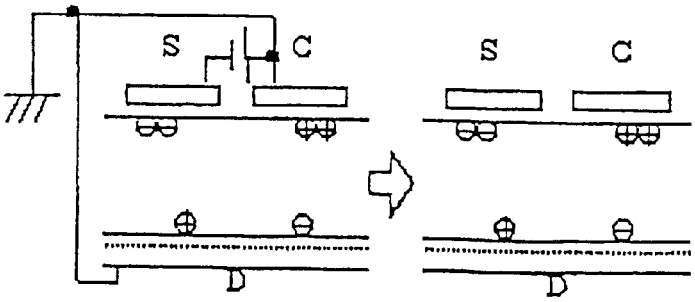
FIG. 15B is a diagram illustrative of movement of charges in the third time period 3 as the scanning time period shown in FIG. 1, where no data pulse is applied to the data electrode.

FIG. 15A is a diagram illustrative of movement of charges in the third time period 3 as the scanning time period shown in FIG. 1, where a data pulse is applied to the data electrode. FIG. 15B is a diagram illustrative of movement of charges in the third time period 3 as the scanning time period shown in FIG. 1, where no data pulse is applied to the data electrode. In the third time period 3 as the scanning time, period, an erasing discharge is caused in a selected cell by applying a scanning pulse Psc with a negative polarity to the scanning electrodes and applying a data pulse Pdata with the positive polarity to the data electrodes. A voltage of the data pulse Pdata is in the range of 50V through 80V. A voltage of the scanning pulse Psc is in the range of −80V through −110V. The erasing discharge is caused but only at a crossing point of the scanning electrode applied with the scanning pulse Psc and the data electrode applied with the data pulse Pdata. The discharge is caused by superimposition of the applied pulse voltages and the wall charges. Upon end of the discharge, wall charges having such a polarity as canceling an externally applied voltage is applied onto the individual electrodes but the voltage levels applied are low whereby small mounts of the wall charges are applied onto the individual electrodes. In contrast, in the cell free of discharge, the wall charges adhered in the charge adjustment time period remain on the electrodes.

Figure 16A:
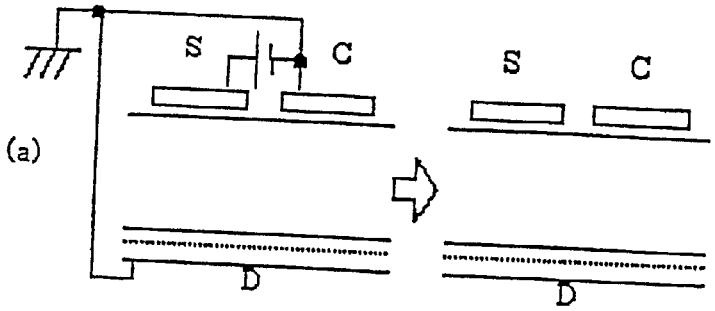
FIG. 16A is a diagram illustrative of movement of charges in the fourth time period 4 as the sustaining time period shown in FIG. 1, where no sustaining discharge is caused.
Figure 16B:
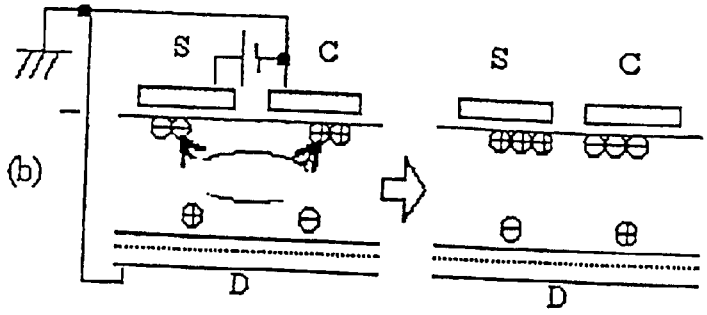
FIG. 16B is a diagram illustrative of movement of charges in the fourth time period 4 as the sustaining time period shown in FIG. 1, where a sustaining discharge is caused.
Figure 17A:
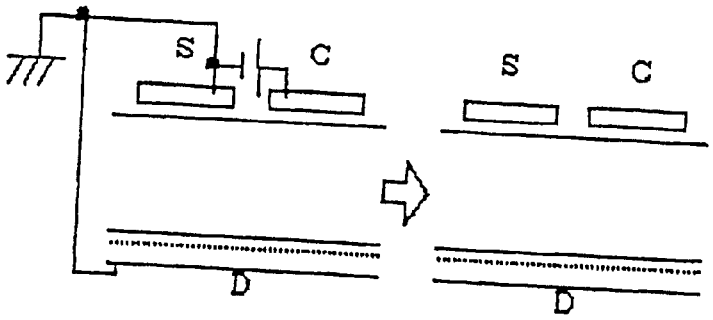
FIG. 17A is a diagram illustrative of movement of charges in the fourth time period 4 as the sustaining time period shown in FIG. 1, where sustaining pulses Psus-s and Psus-c are applied to the scanning electrodes, and no discharge is caused.
Figure 17B:
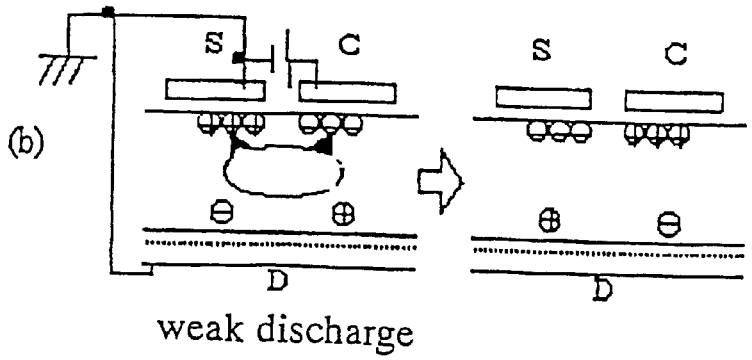
FIG. 17B is a diagram illustrative of movement of charges in the fourth time period 4 as the sustaining time period shown in FIG. 1, where sustaining pulses Psus-s and Psus-c are applied to the scanning electrodes, and a discharge is caused. In the fourth time period 4 as the sustaining time period.

FIG. 16A is a diagram illustrative of movement of charges in the fourth time period 4 as the sustaining time period shown in FIG. 1, where no sustaining discharge is caused. FIG. 16B is a diagram illustrative of movement of charges in the fourth time period 4 as the sustaining time period shown in FIG. 1, where a sustaining discharge is caused. FIG. 17A is a diagram illustrative of movement of charges in the fourth time period 4 as the sustaining time period shown in FIG. 1, where sustaining pulses Psus-s and Psus-c are applied to the scanning electrodes, and no discharge is caused. FIG. 17B is a diagram illustrative of movement of charges in the fourth time period 4 as the sustaining time period shown in FIG. 1, where sustaining pulses Psus-s and Psus-c are applied to the scanning electrodes, and a discharge is caused. In the fourth time period 4 as the sustaining time period, A sustaining pulse Psus-c is applied to the sustaining electrodes C1 - - - Cn before alternating applications of a sustaining pulse Psus-s with a positive polarity to the scanning electrodes S1, - - - Sn and a sustaining pulse Psus-c with a positive polarity to the sustaining electrodes C1, - - - Cn. An extremely small amount of the wall charges on the cell selectively erased in this third time period as the scanning time period cause no sustaining discharge even upon applications of the sustaining pulses Psus-s and Psus-c as shown in FIGS. 16A and 17A. In the cells having no appearance of the erasing discharge, the negative charges remain adhered on the scanning electrodes whilst the positive charges remain adhered on the sustaining electrodes so that voltages due to the wall charges are superimposed with the sustaining pulses Psus-s and Psus-c with the positive polarity to cause a discharge as shown in FIG. 17B. Upon discharge, wall charges are moved to cancel the voltages applied to the individual electrodes. For example, negative charges are adhered on the scanning electrodes whilst the negative charges are adhered on the sustaining electrodes. The next sustaining pulses Psus-s and Psus-c are positive pulses so that the wall charges are superimposed with the sustaining pulses Psus-s and Psus-c to cause a discharge.

Figure 18A:
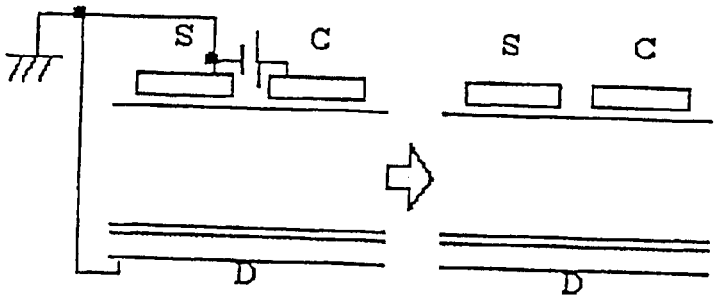
FIG. 18A is a diagram illustrative of movement of charges in the fifth time period 5 as the sustaining and erasing time period shown in FIG. 1, where no sustaining discharge is caused.
Figure 18B:
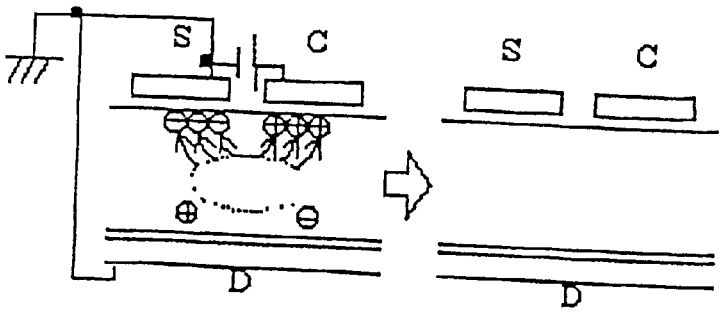
FIG. 18B is a diagram illustrative of movement of charges in the fifth time period 5 as the sustaining and erasing time period shown in FIG. 1, where a sustaining discharge is caused.

FIG. 18A is a diagram illustrative of movement of charges in the fifth time period 5 as the sustaining and erasing time period shown in FIG. 1, where no sustaining discharge is caused. FIG. 18B is a diagram illustrative of movement of charges in the fifth time period 5 as the sustaining and erasing time period shown in FIG. 1, where a sustaining discharge is caused. The wall charges arranged in having applied the sustaining pulse to cause the sustaining discharge are erased. Erasing pulses Psus-c with saw-tooth waveform are applied to erase wall charges.

The above novel method provides the following disadvantages. In the first time period as the priming time period, the saw-tooth waveform pulses are applied to the scanning electrodes or the sustaining electrodes to cause a weak discharge so as to cause a reduced priming brightness. Since the priming discharge is periodically caused independently from the selection and non-selection of the display cells, the reduction of the priming brightness causes a reduction in brightness of the background and a dark ambient contrast may be improved.

Since the wall charges are formed by the weak discharges upon application of the saw-tooth waveform pulses, a small mount of the wall charges is gradually formed. This makes it easy to control the amount of the wall charges.

Since the charge adjustment pulse Ppe-c has the saw-tooth waveform, it is possible to control the amount of the wall charge for the same reasons as described with reference to the priming pulses, whereby a wide stable-operation voltage range for the selective erasing discharge can be obtained.

Figure 19:
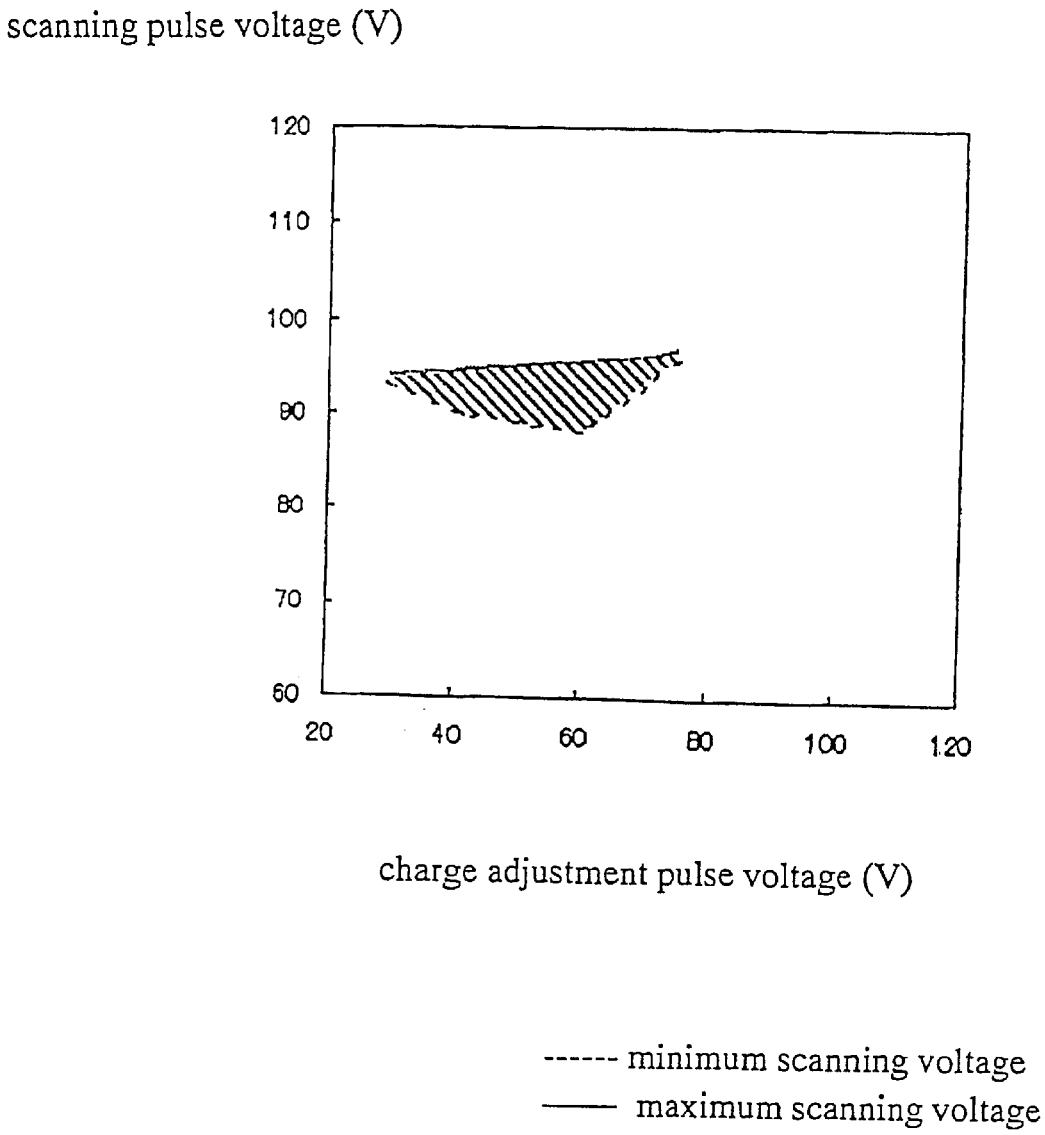
FIG. 19 is a diagram illustrative of operable voltage range of a scanning pulse voltage over charge adjustment pulse voltage in accordance with the conventional driving method.
Figure 20:
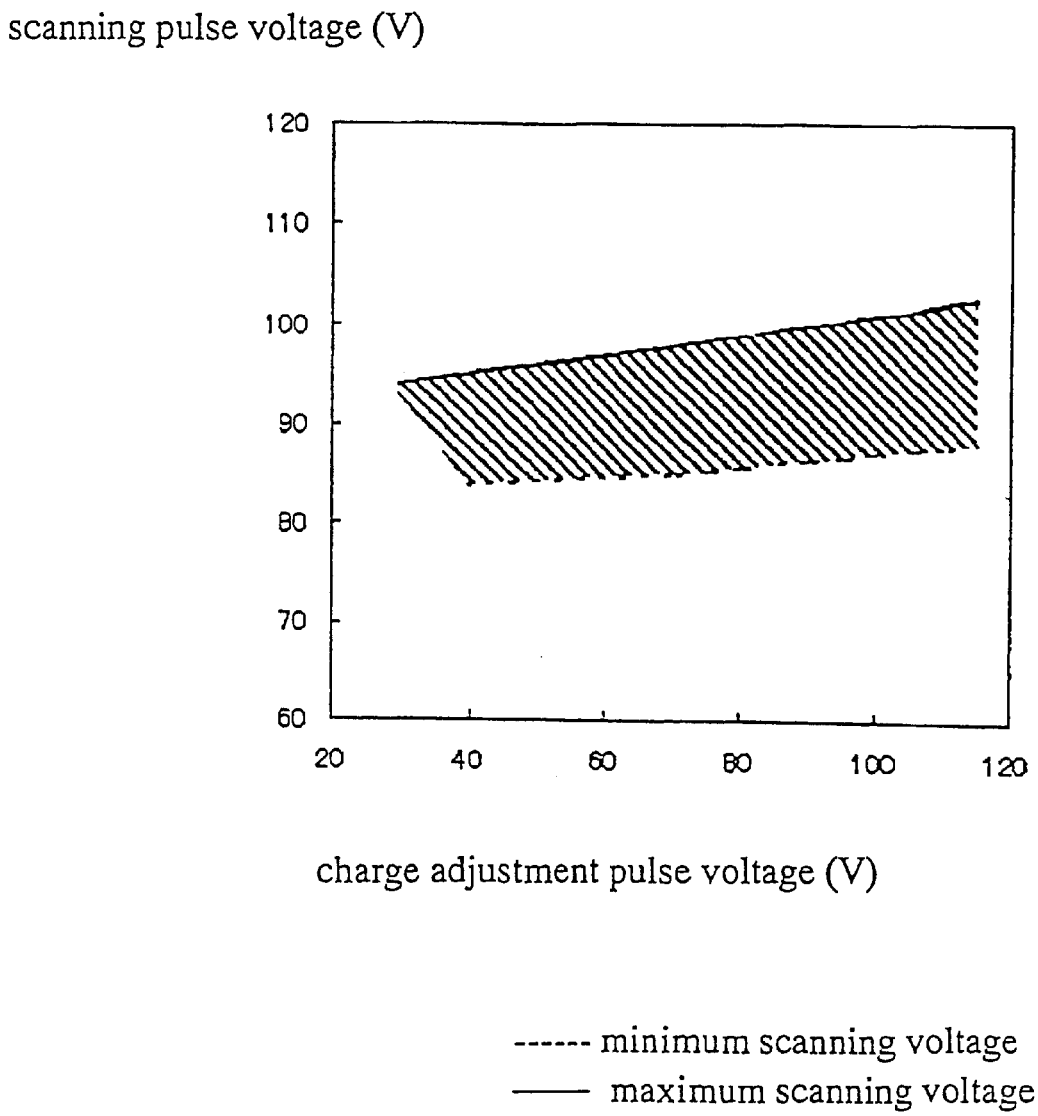
FIG. 20 is a diagram illustrative of operable voltage range of a scanning pulse voltage over charge adjustment pulse voltage in accordance with the novel driving method.

FIG. 19 is a diagram illustrative of operable voltage range of a scanning pulse voltage over charge adjustment pulse voltage in accordance with the conventional driving method. FIG. 20 is a diagram illustrative of operable voltage range of a scanning pulse voltage over charge adjustment pulse voltage in accordance with the novel driving method. The operable voltage range obtained in accordance with the novel driving method is much wider than the operable voltage range obtained in accordance with the conventional driving method.

Second Embodiment

Figure 2:
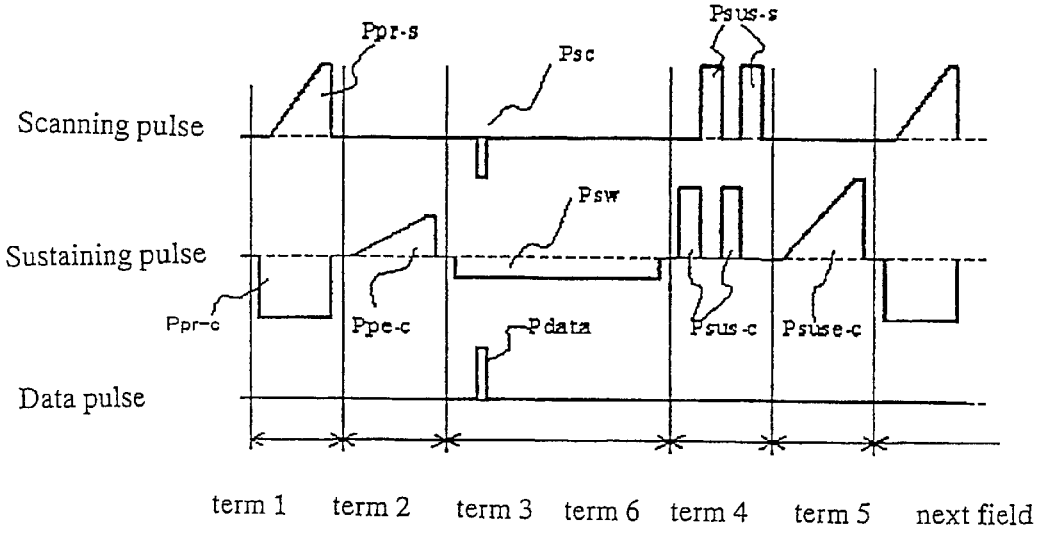
FIG. 2 is a timing chart illustrative of a novel method of driving the AC plasma display in a second embodiment in accordance with the present invention.

A second embodiment according to the present invention will be described in detail with reference to the drawings. FIG. 2 is a timing chart illustrative of a novel method of driving the AC plasma display in a second embodiment in accordance with the present invention. The following descriptions will focus on a difference of the second embodiment from the first embodiment to prevent redundant descriptions.

Figure 22A:
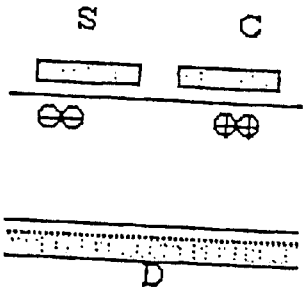
FIG. 22A is a diagram illustrative of wall charges on sustaining electrode, scanning electrode and data electrode before the scanning pulse is applied, where the sub-scanning pulse Psw is applied, in a second embodiment in accordance with the present invention.
Figure 22B:
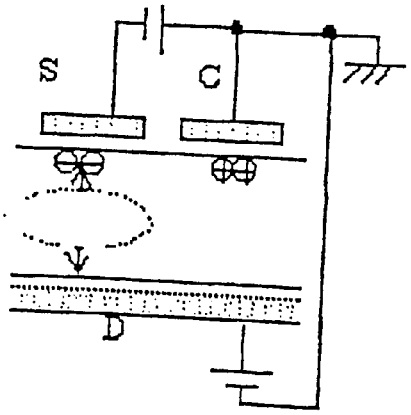
FIG. 22B is a diagram illustrative of wall charges on sustaining electrode, scanning electrode and data electrode when the scanning pulse is applied and the data pulse is applied to initiate the discharge, where the sub-scanning pulse Psw is applied, in a second embodiment in accordance with the present invention.
Figure 22C:
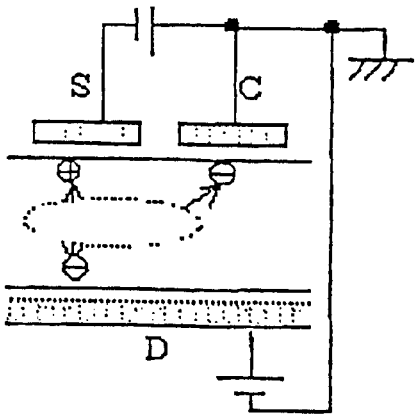
FIG. 22C is a diagram illustrative of wall charges on sustaining electrode, scanning electrode and data electrode during the discharge, where the sub-scanning pulse Psw is applied, in a second embodiment in accordance with the present invention.
Figure 22D:
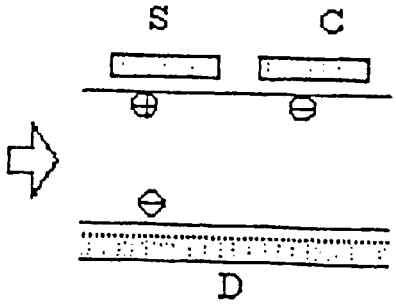
FIG. 22D is a diagram illustrative of wall charges on sustaining electrode, scanning electrode and data electrode after the discharge has been completed, where the sub-scanning pulse Psw is applied, in a second embodiment in accordance with the present invention.
Figure 23A:
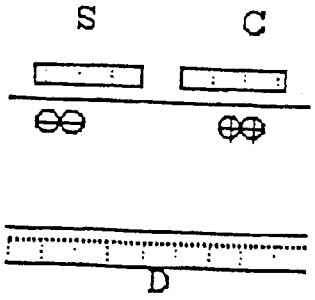
FIG. 23A is a diagram illustrative of wall charges on sustaining electrode, scanning electrode and data electrode before the scanning pulse is applied, where no sub-scanning pulse Psw is applied, in a second embodiment in accordance with the present invention.
Figure 23B:
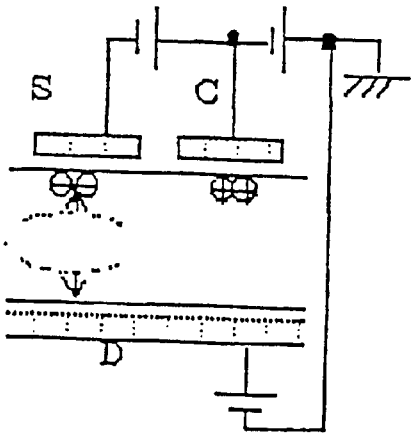
FIG. 23B is a diagram illustrative of wall charges on sustaining electrode, scanning electrode and data electrode when the scanning pulse is applied and the data pulse is applied to initiate the discharge, where no sub-scanning pulse Psw is applied, in a second embodiment in accordance with the present invention.
Figure 23C:
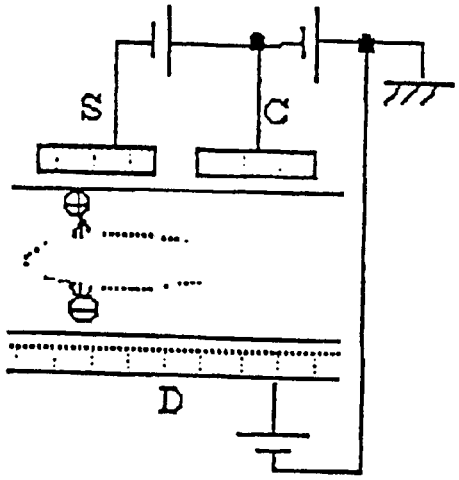
FIG. 23C is a diagram illustrative of wall charges on sustaining electrode, scanning electrode and data electrode during the discharge, where no sub-scanning pulse Psw is applied, in a second embodiment in accordance with the present invention.
Figure 23D:
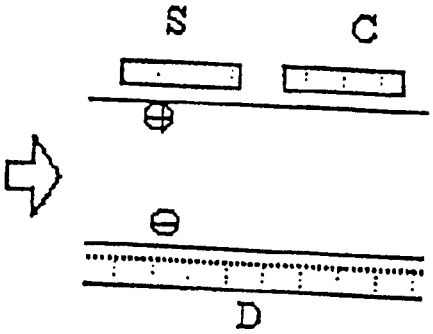
FIG. 23D is a diagram illustrative of wall charges on sustaining electrode, scanning electrode and data electrode after the discharge has been completed, where no sub-scanning pulse Psw is applied, in a second embodiment in accordance with the present invention.
Figure 24:
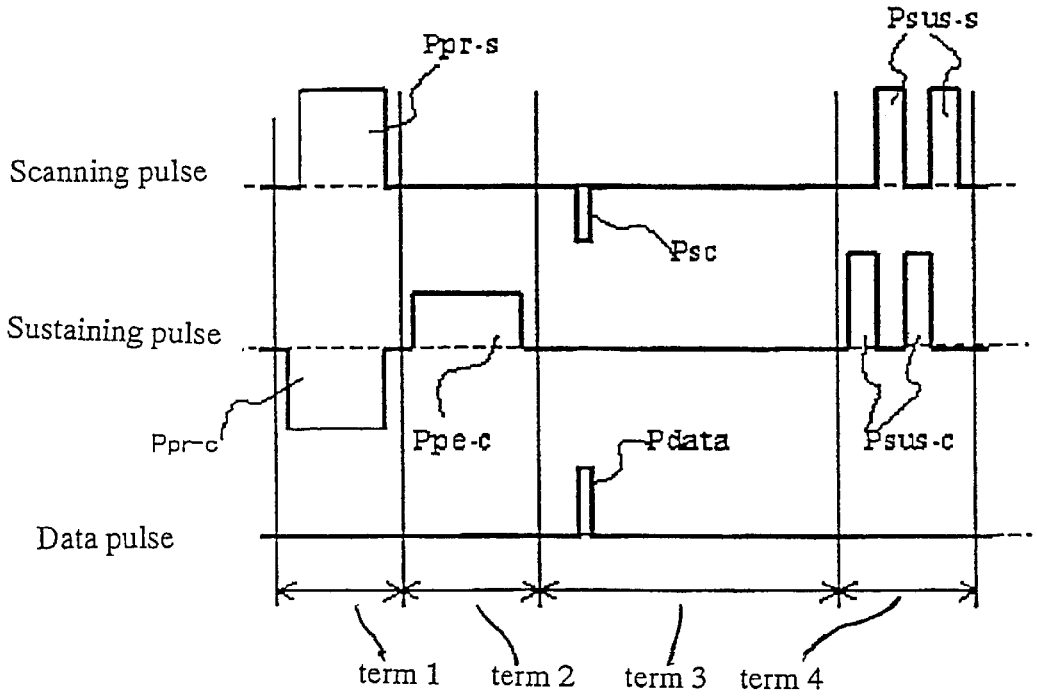
FIG. 24 prior art
FIG. 24 is a timing chart illustrative of a first conventional method of driving the plasma display panel.

In the third time period as the scanning time period, a sub-scanning pulse Psw with a negative polarity is applied to the sustaining electrodes C1 - - - Cn to reduce a potential difference between the scanning electrodes and the sustaining electrodes. In discharge, the wall charges are moved to cancel the applied voltages to the individual electrodes. Application of the sub-scanning pulse Psw with the negative polarity prevents negative charges from being adhered onto the sustaining electrodes when the erasing discharge is caused between the scanning electrodes and he data electrodes. FIG. 22A is a diagram illustrative of wall charges on sustaining electrode, scanning electrode and data electrode before the scanning pulse is applied, where the sub-scanning pulse Psw is applied, in a second embodiment in accordance with the present invention. FIG. 22B is a diagram illustrative of wall charges on sustaining electrode, scanning electrode and data electrode when the scanning pulse is applied and the data pulse is applied to initiate the discharge, where the sub-scanning pulse Psw is applied, in a second embodiment in accordance with the present invention. FIG. 22C is a diagram illustrative of wall charges on sustaining electrode, scanning electrode and data electrode during the discharge, where the sub-scanning pulse Psw is applied, in a second embodiment in accordance with the present invention. FIG. 22D is a diagram illustrative of wall charges on sustaining electrode, scanning electrode and data electrode after the discharge has been completed, where the sub-scanning pulse Psw is applied, in a second embodiment in accordance with the present invention. FIG. 23A is a diagram illustrative of wall charges on sustaining electrode, scanning electrode and data electrode before the scanning pulse is applied, where no sub-scanning pulse Psw is applied, in a second embodiment in accordance with the present invention. FIG. 23B is a diagram illustrative of wall charges on sustaining electrode, scanning electrode and data electrode when the scanning pulse is applied and the data pulse is applied to initiate the discharge, where no sub-scanning pulse Psw is applied, in a second embodiment in accordance with the present invention. FIG. 23C is a diagram illustrative of wall charges on sustaining electrode, scanning electrode and data electrode during the discharge, where no subscanning pulse Psw is applied, in a second embodiment in accordance with the present invention. FIG. 23D is a diagram illustrative of wall charges on sustaining electrode, scanning electrode and data electrode after the discharge has been completed, where no sub-scanning pulse Psw is applied, in a second embodiment in accordance with the present invention.

In case of no application of the sub-scanning pulse, the discharge is initiated between the scanning electrodes and he data electrodes to cause adhesions of the wall charges so as to cancel the potential differences between the electrodes. Adhesion of the negative charges on the sustaining electrodes causes superimposition of the wall charges over the sustaining pulses. In order to prevent erroneous discharge, the available voltage ranges of the sustaining pulses Psus-s and Psus-c are restricted. Application of the sub-scanning pulse Psw causes a reduction in potential difference between the scanning electrode and the sustaining electrode whereby wall charges are unlikely to be adhered onto the sustaining electrodes. A wide available voltage range of the sustaining pulses Psus-s and Psus-c can be obtained even in order to prevent erroneous discharge.

Third Embodiment

Figure 3:
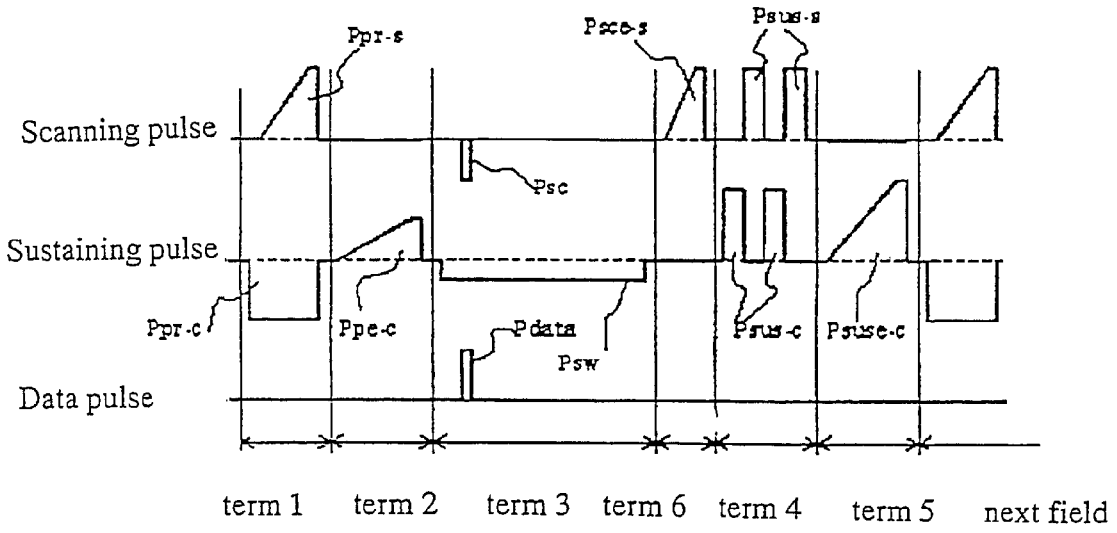
FIG. 3 is a timing chart illustrative of a novel method of driving the AC plasma display in a third embodiment in accordance with the present invention.

A third embodiment according to the present invention will be described in detail with reference to the drawings. FIG. 3 is a timing chart illustrative of a novel method of driving the AC plasma display in a third embodiment in accordance with the present invention. The following descriptions will focus on a difference of the third embodiment from the second embodiment to prevent redundant descriptions.

Figure 21:
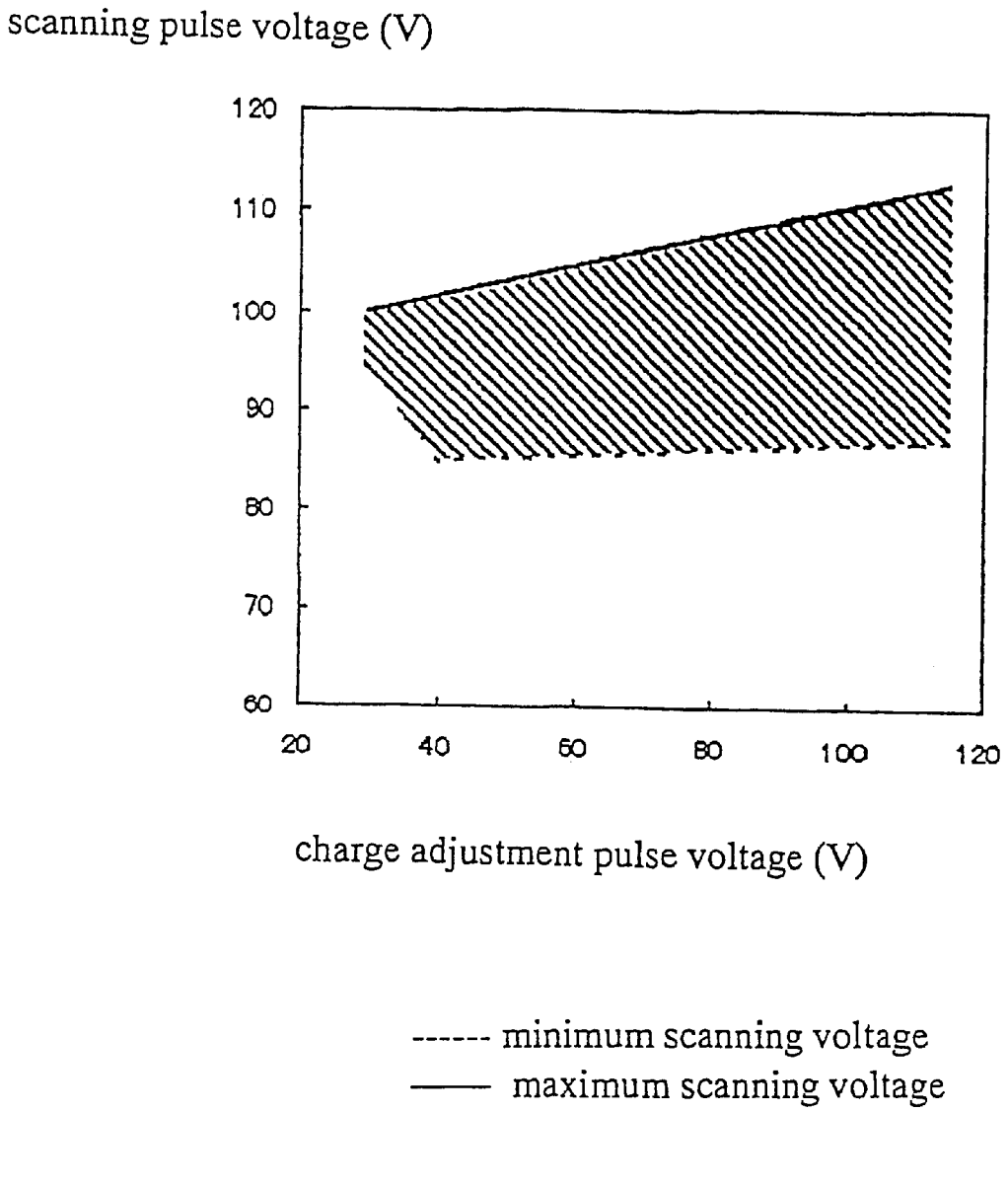
FIG. 21 is a diagram illustrative of operable voltage range of a scanning pulse voltage over charge adjustment pulse voltage in the third embodiment in accordance with the novel driving method.

A sixth time period as a pre-sustaining erasing time period is provided between the third time period as the scanning time period and the fourth time period as the sustaining time period. A pre-sustaining erasing pulse Psce-s with a saw-tooth waveform and a positive polarity is applied to the scanning electrodes. If the scanning pulse Psc with a high voltage level is applied to cause an erasing discharge in the third time period as the scanning time period, an excess amount of the positive charges may be adhered onto the scanning electrodes. Adhesions of the excess amount of the positive charges on the scanning electrodes causes such a superimposition of the wall charges and the sustaining pulses Psus-s and Psus-c as to cause the erroneous discharge. In order to prevent the erroneous discharge, the pre-sustaining erasing pulse Psce-s with a saw-tooth waveform and a positive polarity is applied to the scanning electrodes so as to erase the excess positive charges adhered on the scanning electrodes so that no erroneous discharge can be caused upon the sustaining pulses Psus-s and Psus-c. A wide available range of the sustaining pulses Psus-s and Psus-c can be obtained. FIG. 21 is a diagram illustrative of operable voltage range of a scanning pulse voltage over charge adjustment pulse voltage in the third embodiment in accordance with the novel driving method. The operable voltage range obtained in this third embodiment in accordance with the novel driving method is much wider than the operable voltage range obtained in the first embodiment as shown in FIG. 20.

Fourth Embodiment

Figure 4:
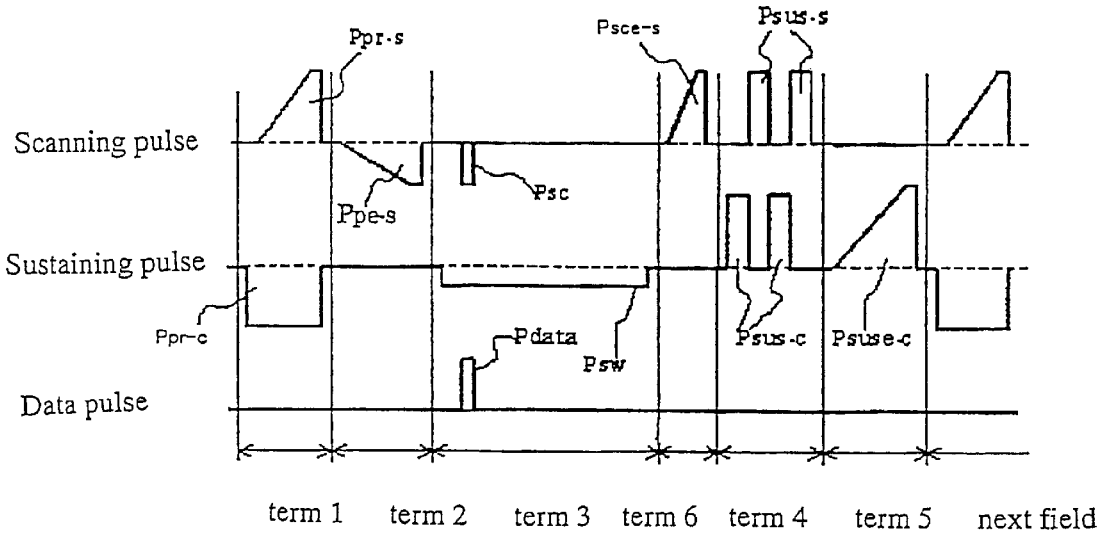
FIG. 4 is a timing chart illustrative of a novel method of driving the AC plasma display in a fourth embodiment in accordance with the present invention.

A fourth embodiment according to the present invention will be described in detail with reference to the drawings. FIG. 4 is a timing chart illustrative of a novel method of driving the AC plasma display in a fourth embodiment in accordance with the present invention. The following descriptions will focus on a difference of the fourth embodiment from the first embodiment to prevent redundant descriptions, In pale of the charge adjustment pulse Ppe-c, a saw-tooth waveform pulse Ppe-s with a negative polarity is applied to the scanning electrodes in the second time period as the charge adjustment time period. In the first time period as the priming time period, charges are adhered on not only the scanning electrode and the sustaining electrode but also the data electrode. In this case, positive charges are adhered on the data electrode in the vicinity of the scanning electrode whilst negative charges are adhered on the data electrode in the vicinity of the sustaining electrode. The saw-tooth waveform pulse Ppe-s with a negative polarity is applied to adjust the amount of the positive wall charge on the data electrode in the vicinity of the scanning electrode. It the excess amounts of the wall charges are adhered on the data electrodes, the scanning electrode and the sustaining electrode, erroneous discharges may be caused due to only the wall charges. Particularly, the scanning pulse Psc has the negative polarity, even under no application of the data pulse, a discharge may be caused between the scanning electrode and the data electrode on which the positive charges are adhered. The saw-tooth waveform pulse Ppe-s with a negative polarity is applied to reduce the amount of the positive charges adhered on the sustaining electrode and the data electrode in the vicinity of the scanning electrode. Wide available voltage ranges of the scanning pulses Psc and the data pulse Pdata can be obtained.

Fifth Embodiment

Figure 5:
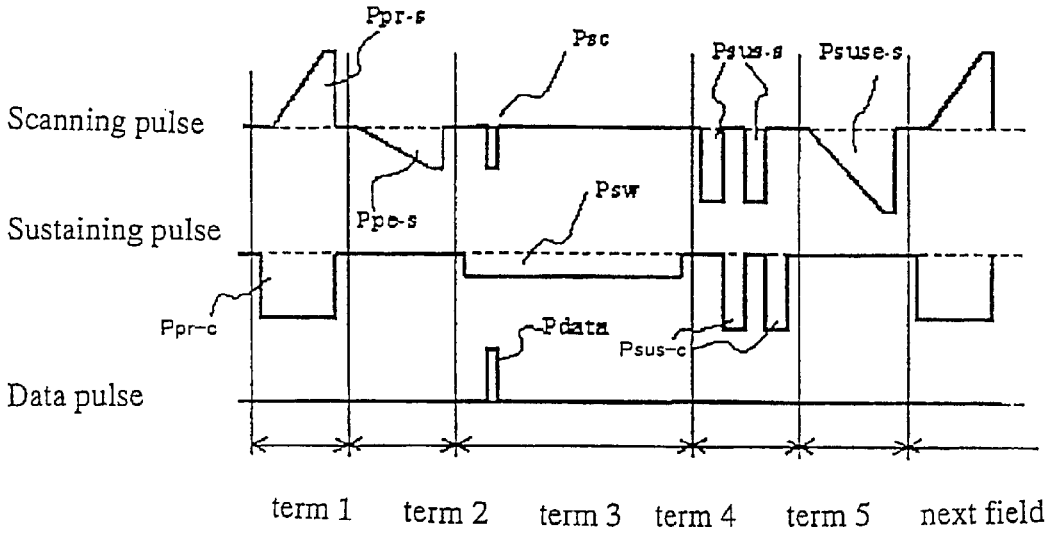
FIG. 5 is a timing chart illustrative of a novel method of driving the AC plasma display in a fifth embodiment in accordance with the present invention.

A fifth embodiment according to the present invention will be described in detail with reference to the drawings. FIG. 5 is a timing chart illustrative of a novel method of driving the AC plasma display in a fifth embodiment in accordance with the present invention. The following descriptions will focus on a difference of the fifth embodiment from the first embodiment to prevent redundant descriptions.

The sustaining pulses Psus-s and Psus-c are applied in the fourth time period as the sustaining time period, wherein the sustaining pulse Psus-s is first applied before alternating applications of the sustaining pulses Psus-c to the sustaining electrode and the sustaining pulses Psus-s to the scanning electrode. If the sustaining pulses Psus-s and Psus-c with the positive polarity are applied, then the potential of the data electrode is relatively negative, so that the data electrode becomes cathode and the sustaining electrode becomes anode. In the third time period as the scanning time period, increase in voltage of the scanning pulse Psc and he data pulse Pdata causes a strong selective erasing discharge, whereby an incomplete erasure of the wall charges can be obtained. Since the data electrode serves as the anode and the scanning electrode serves as the cathode, negative charges are adhered onto the data electrode and positive charges are adhered onto the scanning electrode. The potential of the wall charges are superimposed with the voltage of the sustaining pulses Psus-s and Psus-c having the positive polarity whereby an erroneous discharge may be caused. The sustaining discharge between the scanning electrode and the data electrode may make the sustaining discharge weaken. The applications of the sustaining pulses Psus-s and Psus-c with the negative polarity allows the wall charges to cancel the sustaining voltage to prevent erroneous discharge. Wide available voltage ranges of the sustaining pulse Psus-s and Psus-c can be obtained.

Sixth Embodiment

Figure 6:
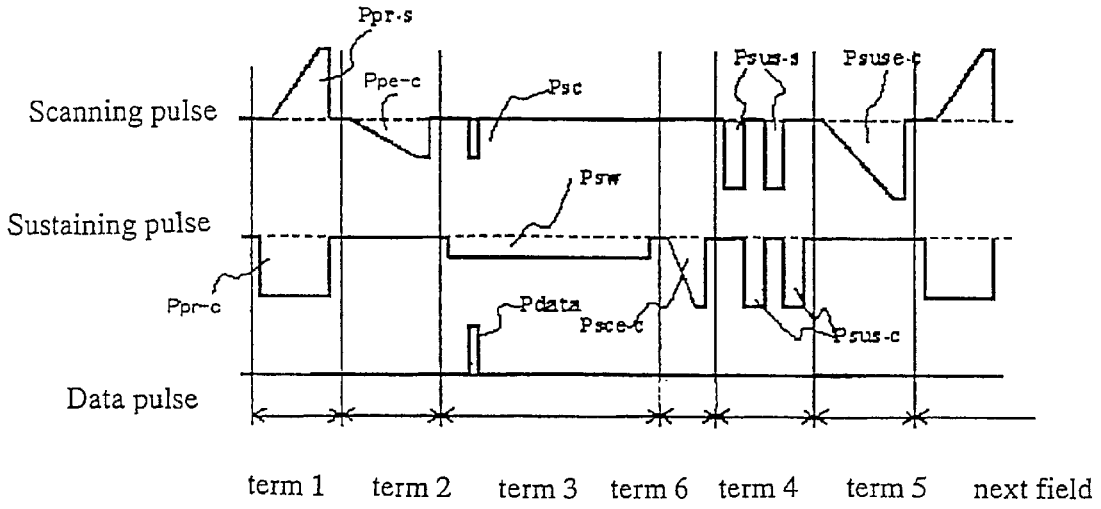
FIG. 6 is a timing chart illustrative of a novel method of driving the AC plasma display in a sixth embodiment in accordance with the present invention.

A sixth embodiment according to the present invention will be described in detail with reference to the drawings. FIG. 6 is a timing chart illustrative of a novel method of driving the AC plasma display in a sixth embodiment in accordance with the present invention. The following descriptions will focus on a difference of the sixth embodiment from the fifth embodiment to prevent redundant descriptions.

A sixth time period as a pre-sustaining erasing time period is provided between the third time period as the scanning time period and the fourth time period as the sustaining time period. A pre-sustaining erasing pulse Psce-c with a saw-tooth waveform and a negative polarity is applied to the sustaining electrodes. If the scanning pulse Psc with a high voltage level is applied to cause an erasing discharge in the third time period as the scanning time period, an exces amount of the positive charges may be adhered onto the scanning electrodes. Adhesions of the excess amount of the positive charges on the scanning electrodes causes such a superimposition of the wall charges and the sustaining pulses Psus-s and Psus-c as to cause the erroneous discharge. In order to prevent the erroneous discharge, the pre-sustaining erasing pulse Psce-c with a saw-tooth waveform and a negative polarity is applied to the sustaining electrodes so as to erase the excess positive charges adhered on the scanning electrodes so that no erroneous discharge can be caused upon the sustaining pulses Psus-s and Psus-c. A wide available range of the sustaining pulses Psus-s and Psus-c can be obtained. As a result, almost the same effects as the third embodiment can be obtained.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A method of driving an AC plasma display comprising the steps of:

at least any one of applying a first type priming pulse with a positive polarity having a gentle rise to a scanning electrode and applying a second type priming pulse with a negative polarity having a gentle fall to a sustaining electrode;

at least any one of applying said sustaining electrode with a first charge adjustment pulse with a positive polarity having a gentle rise as an erasing pulse for reducing wall charges formed on said sustaining electrode by priming, and applying said scanning electrode with a second charge adjustment pulse with a negative polarity having a gentle fall as an erasing pulse for reducing wall charges formed on said scanning electrode by priming;

applying a scanning pulse with a negative polarity onto said scanning electrode and a data pulse with a positive polarity onto a data electrode so as to erase the wall charges of a selected cell;

at least any one of applying a first erasing pulse with a positive polarity having a gentle rise to said scanning electrode and applying a second erasing pulse with a negative polarity having a gentle fall to said sustaining electrode so as to erase positive charges adhered on said scanning electrode upon erasing the wall charges of sad selected cell; and sustaining a luminescence during a sustaining time period at unerased parts.

2. The method as claimed in claim 1, wherein one sub-field representing a gray scale comprises a priming time period, a charge adjustment time period, a scanning time period, and a sustaining and erasing time period.

3. The method as claimed in claim 2, wherein a sub-scanning pulse is applied to said sustain electrode in said scanning time period.

4. The method as claimed in claim 2, wherein in said sustaining time period, a sustaining pulse with the negative polarity is first applied to said scanning electrode and then said sustaining pulses are alternatively applied to said sustaining electrode and said scanning electrode.

5. A method of driving an AC plasma display comprising the steps of:

at least any one of applying a first type priming pulse with a saw-tooth waveform and a positive polarity having a gentle rise to a scanning electrode and applying a second type priming pulse with a saw-tooth waveform and a negative polarity having a gentle fall to a sustaining electrode;

at least any one of applying said sustaining electrode with a first charge adjustment pulse with a positive polarity having a gentle rise as an erasing pulse for reducing wall charges forned on said sustaining electrode by priming, and applying said scanning electrode with a second charge adjustment pulse with a negative polarity having a gentle fall as an erasing pulse for reducing wall charges formed on said scanning electrode by priming;

applying a scanning pulse with a negative polarity onto said scanning electrode and a data pulse with a positive polarity onto a data electrode so as to erase the wall charges of a selected cell;

at least any one of applying a first erasing pulse with a positive polarity having a gentle rise to said scanning electrode and applying a second erasing pulse with a negative polarity having a gentle fall to said sustaining electrode so as to erase positive charges adhered on said scanning electrode upon erasing the wall charges of said selected cell; and sustaining a luminescence during a sustaining time period at unerased parts.

6. The method as claimed in claim 5, wherein one sub-field representing a gray scale comprises a priming time period, a charge adjustment time period, a scanning time period, and a sustaining and erasing time period.

7. The method as claimed in claim 6, wherein said erasing pulse is applied to the sustaining electrode in said sustaining and erasing time period.

8. The method as claimed in claim 6, wherein a sub-scanning pulse is applied to said sustaining electrode in said scanning time period.

9. The method as claimed in claim 6, wherein said sustaining and erasing time period is between said scanning time period and said sustaining time period so that in sad sustaining and erasing time period, a pre-sustaining erasing pulse with a saw-tooth waveform and a positive polarity is applied to the scanning electrode.

10. The method as claimed in claim 6, wherein said sustaining and erasing time period is between said scanning time period and said sustaining time period so that in said sustaining and erasing time period, a pre-sustaining erasing pulse with a saw-tooth waveform and a negative polarity is applied to the scanning electrode.

11. An AC plasma display comprising;

means for at least any one of applying a first type priming pulse with a positive polarity having a gentle rise to a scanning electrode and applying a second type priming pulse with a negative polarity having a gentle fall to a sustaining electrode;

means for at least any one of applying said sustaining electrode with a first charge adjustment pulse with a positive polarity having a gentle rise as an erasing pulse for reducing wall charges formed on said sustaining electrode by priming, and applying said scanning electrode with a second charge adjustment pulse with a negative polarity having a gentle fall as an erasing pulse for reducing wall charges formed on said scanning electrode by priming;

means for applying a scanning pulse with a negative polarity onto said scanning electrode and a data pulse with a positive polarity onto a data electrode so as to erase the wall charges of a selected cell;

means for at least any one of applying a first erasing pulse with a positive polarity having a gentle rise to said scanning electrode and applying a second erasing pulse with a negative polarity having a gentle fall to said sustaining electrode so as to erase positive charges adhered on said scanning electode upon erasing the wall charges of said selected cell; and means for sustaining a luminescence during a sustaining time period at unerased parts.

12. An AC plasma display comprising:

means for at least any one of applying a first type priming pulse with a saw-tooth waveform and a positive polarity having a gentle rise to a scanning electrode and applying a second type priming pulse with a saw-tooth waveform and a negative polarity having a gentle fall to a sustaining electrode;

means for at least any one of applying said sustaining electrode with a first charge adjustment pulse with a positive polarity having a gentle rise as an erasing pulse for reducing wall charges formed on said sustaining electrode by priming, and applying said scanning electrode with a second charge adjustment pulse with a negative polarity having a gentle fall as an erasing pulse for reducing wall charges formed on said scanning electrode by priming;

means for applying a scanning pulse with a negative polarity onto said scanning electrode and a data pulse with a positive polarity onto a data electrode so as to erase the wall charges of a selected cell;

means for at least any one of applying a first erasing pulse with a positive polarity having a gentle rise to said scanning electrode and applying a second erasing pulse with a negative polarity having a gentle fall to said sustaining electrode so as to erase positive charges adhered on said scanning electrode upon erasing the wall charges of said selected cell; and means for sustaining a luminescence during a sustaining time period at unerased parts.

* * * * *